US006466080B2

(12) United States Patent
Kawai et al.

(10) Patent No.: US 6,466,080 B2
(45) Date of Patent: Oct. 15, 2002

(54) CONSTANT CURRENT DRIVER CIRCUIT

(75) Inventors: Takumi Kawai; Akihiko Ono, both of Kasugai (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/815,039

(22) Filed: Mar. 23, 2001

(65) Prior Publication Data

US 2002/0044008 A1 Apr. 18, 2002

(30) Foreign Application Priority Data

Oct. 10, 2000 (JP) ..... 2000-308853

(51) Int. Cl.[7] ..... G05F 1/10
(52) U.S. Cl. ..... 327/538
(58) Field of Search ..... 323/312, 315; 327/374, 376, 377, 382, 530, 534, 535, 538, 543

(56) References Cited

U.S. PATENT DOCUMENTS 4,417,240 A * 11/1983 Ahmed ..... 327/109
4,864,216 A * 9/1989 Kalata et al. ..... 323/315
4,941,004 A * 7/1990 Pham et al. ..... 347/119
5,384,740 A * 1/1995 Etoh et al. ..... 323/313
5,530,397 A * 6/1996 Nakai et al. ..... 327/538
5,796,767 A * 8/1998 Aizawa ..... 372/38.02
6,194,955 B1 * 2/2001 Ishida ..... 327/538

* cited by examiner

*Primary Examiner*—Jeffrey Zweizig
(74) *Attorney, Agent, or Firm*—Staas & Halsey LLP

(57) ABSTRACT

A constant-current driver circuit for on-off controlling an output current at a high speed is provided. The constant-current driver circuit includes a first MOS transistor to which a reference current is provided and a second MOS transistor connected to the first MOS transistor for generating an output current having a predetermined ratio to the reference current. A switch circuit is connected to the second MOS transistor to on-off control the output current in accordance with the input signal. A bias circuit is connected to the gate of the second MOS transistor to provide a bias voltage to the gate of the second MOS transistor so that variation in the gate voltage of the second MOS transistor is suppressed.

8 Claims, 8 Drawing Sheets

CONSTANT CURRENT DRIVER CIRCUIT

BACKGROUND OF THE INVENTION

The present invention relates to a constant-current driver circuit, and, more specifically, relates to a constant-current driver circuit that drives a load element, such as an LED, by on-off controlling an output current in response to an input signal.

In a semiconductor integrated circuit device, a constant-current driver circuit or a basic operation circuit is widely used. For example, the constant-current driver circuit is mounted on an infrared-ray data communication apparatus or various portable OA devices to drive a light-emitting diode (LED) used for infrared-ray data communication. The constant-current driver circuit performs on-off control of the output current in response to a pulse transmission signal to operate the LED for emitting light or stop the emission repeatedly. Recently, with the diversification of data and the increase in the amount of communication data, a communication speedup of the constant-current driver circuit for infrared-ray data communication is required.

FIG. 1 is a schematic circuit diagram of a first constant-current driver circuit 10 of the prior art.

The constant-current driver circuit 10 includes a differential pair 11 and a constant-current source 12. The differential pair 11 includes first and second N channel MOS (NMOS) transistors Q1, Q2. The sources of the first and second transistors Q1, Q2 are connected to each other and to a low potential power supply VSS via a constant-current source 12. The drain of the first transistor Q1 is connected to a high potential power supply VDD, and the drain of the second transistor Q2 is connected to an output terminal of the constant-current driver circuit 10. A cathode of the light-emitting diode (LED) D1 is connected to the output terminal, and an anode of the light-emitting diode D1 is connected to the high potential power supply VDD.

A reference voltage Vref is provided to the gate of the first transistor Q1 (or the second transistor Q2), and a pulse input signal Sin is provided to the gate of the second transistor Q2 (or the first transistor Q1). The first and second transistors Q1, Q2 are complementarily turned on or off based on the levels of the reference voltage Vref and the input signal Sin so that an output current Iout intermittently flows into the light-emitting diode D1. As a result, the constant-current driver circuit 10 operates the light-emitting diode D1 to emit light or stop the emission in response to the input signals Sin.

The differential pair 11 of the constant-current driver circuit 10 is suitable for the high speed operation. However, a current always flows into the constant-current source 12. Thus, the current consumption of the constant-current driver circuit 10 is increased.

FIG. 2 is a schematic circuit diagram of a second constant-current driver circuit 20 of the prior art.

The constant-current driver circuit 20 includes a constant-current source 21, an analog switch 22, and a current mirror circuit 23. The current mirror circuit 23 includes input and output NMOS transistors Q3, Q4. The source of the input transistor Q3 is connected to a low potential power supply VSS, and the drain thereof is connected to a high potential power supply VDD via the analog switch 22 and the constant-current source 21. The gate of the input transistor Q3 is connected to its drain and to the gate of the output transistor Q4. The source of the output transistor Q4 is connected to a low potential power supply VSS, and the drain thereof is connected to the output terminal of the constant-current driver circuit 20. The transistors Q3 and Q4 have a size ratio of M:N therebetween. Therefore, the constant-current driver circuit amplifies the reference current Iref provided from the constant-current source 21 in accordance with the size ratio and generates the output current Iout.

FIGS. 3A and 3B are schematic circuit diagrams of a third constant-current driver circuit 30 of the prior art.

As shown in FIG. 3A, the constant-current driver circuit 30 includes a constant-current source 31, a current mirror circuit 32, and first and second analog switches 33, 34. The first and second analog switches 33, 34 are connected between the sources of the transistors Q3, Q4 of the current mirror circuit 32 and a low potential power supply VSS, respectively. As shown in FIG. 3B, the first and second analog switches 33, 34 are preferably third and fourth NMOS transistors Q5, Q6 with input signals Sin provided to their gates.

In the constant-current driver circuit 30, the third and fourth transistors Q5, Q6 are on-off controlled in synchronization with the communication signal S2. The reference current Iref provided from the constant-current source 31 is amplified in accordance with the size ratio between the first and second transistors Q3, Q4, and the output current Iout is provided to the light-emitting diode D1.

In the constant-current driver circuits 20, 30, the light-emitting diode D1 emits light or stops the emission by the on-off control of the analog switches 22, 33, and 34, and only when the light-emitting diode D1 emits light, the reference current Iref flows. Therefore, the increase in the current consumption is prevented.

A MOS transistor has the source, the drain, the gate, and a parasitic capacitance formed between a backgate substrate and the source, the drain and the gate. The value of the parasitic capacitance corresponds to the transistor size. In the constant-current driver circuit 20, the second transistor Q4 has parasitic capacitance lager than the first transistor Q3.

Thus, when the analog switch 22 is turned on by the transmission signal S2, the parasitic capacitance of the transistors Q3, Q4 is charged by the reference current Iref so that the gate voltages of the transistors Q3, Q4 increases. Therefore, time for increasing the gate voltage is determined by the parasitic capacitance, that is, the transistor size. When the switch 22 is turned off, the gate voltages of the transistors Q3, Q4 gradually decrease according to the magnitude of the parasitic capacitance. As a result, the leading edge and the trailing edge of the output current Iout of the constant-current driver circuit 20 grow dull and the high speed emission or stop of the emission of the light-emitting diode D1 becomes difficult.

When the first and second analog switches 33, 34 of the constant-current driver circuit 30 are turned on, the gate voltage Vg of the transistors Q3 or Q4 is temporarily reduced by the voltage AH as shown in FIG. 4, and then, it gradually increases according to the parasitic capacitance. As a result, the leading edge of the output current Iout grows dull, and the high speed emission or stop of the emission of the light-emitting diode D1, or the high speed switching operation, becomes difficult. To understand the effects of the parasitic capacitance more easily, FIG. 4 shows a waveform of the gate voltage Vg when the first analog switch 33 in FIG. 3A is turned on, and only the second analog switch 34 is turned on or off by the transmission signal S2.

SUMMARY OF THE INVENTION

An object of the present invention is to provide a constant-current driver circuit that on-off controls the output current at a high speed.

In a first aspect of the present invention, a constant-current driver circuit is provided. The constant-current driver circuit includes a first MOS transistor to which a reference current is provided and a second MOS transistor connected to the first MOS transistor for generating an output current having a predetermined ratio to the reference current. A switch circuit is connected to the second MOS transistor for on-off controlling the output current in accordance with the input signal. A bias circuit is connected to the gate of the second MOS transistor for providing a bias voltage to the gate of the second MOS transistor so that variation in the gate voltage of the second MOS transistor is suppressed.

In a second aspect of the present invention, a constant-current driver circuit is provided. The constant-current driver circuit includes a reference current circuit including a first MOS transistor and a first constant-current source connected to the first MOS transistor and providing a reference current to the first MOS transistor. The reference current circuit generates a gate voltage of the first MOS transistor in accordance with a first control signal. The constant-current driver circuit includes an output current circuit having a second MOS transistor which generates an output current having a predetermined ratio to the reference current. The gate of the second MOS transistor is connected to the gate of the first MOS transistor. The output current circuit includes a first switch circuit connected to the second MOS transistor in series for on-off controlling the output current in accordance with a second control signal. A bias circuit is connected to the gate of the second MOS transistor for providing a bias voltage to the gate of the second MOS transistor in accordance with a third control signal so that variation in the gate voltage of the second MOS transistor in the on control of the output current is suppressed.

In a third aspect of the present invention, a method of controlling a gate voltage of an output transistor in a constant-current driver circuit is provided. The constant-current driver includes an input transistor for receiving a reference current, an output transistor for generating an output current having a predetermined ratio to the reference current, and a switch circuit for on-off controlling the output current in response to an input signal. The method includes: providing a bias voltage to the gate of the output transistor when the output current is off controlled by the switch circuit; and generating an output current of the output transistor by on controlling the output current by the switch circuit.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
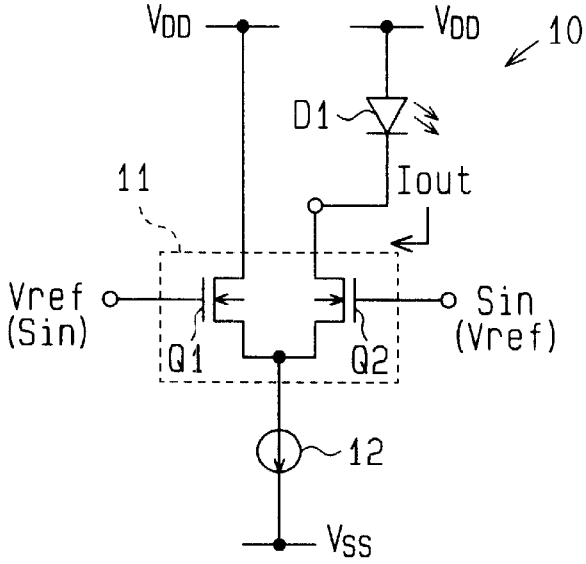
Fig.1 (Prior Art)
FIG. 1 is a schematic circuit diagram of a first constant-current driver circuit of the prior art.
Figure 2:
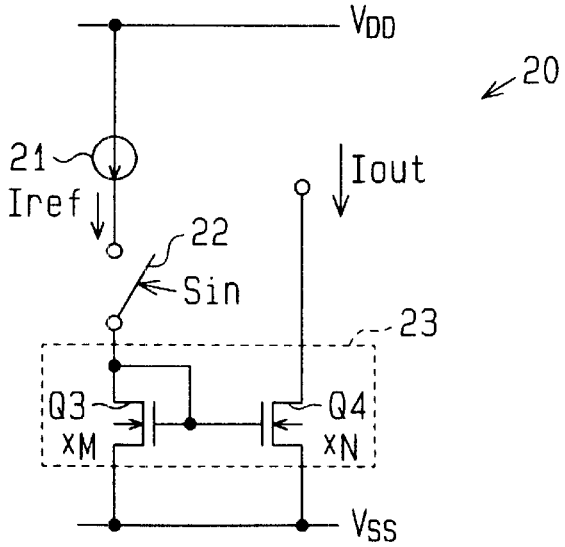
Fig.2 (Prior Art)
FIG. 2 is a schematic circuit diagram of a second constant-current driver circuit of the prior art.

In the drawings, like numerals are used like elements throughout.

Figure 5:
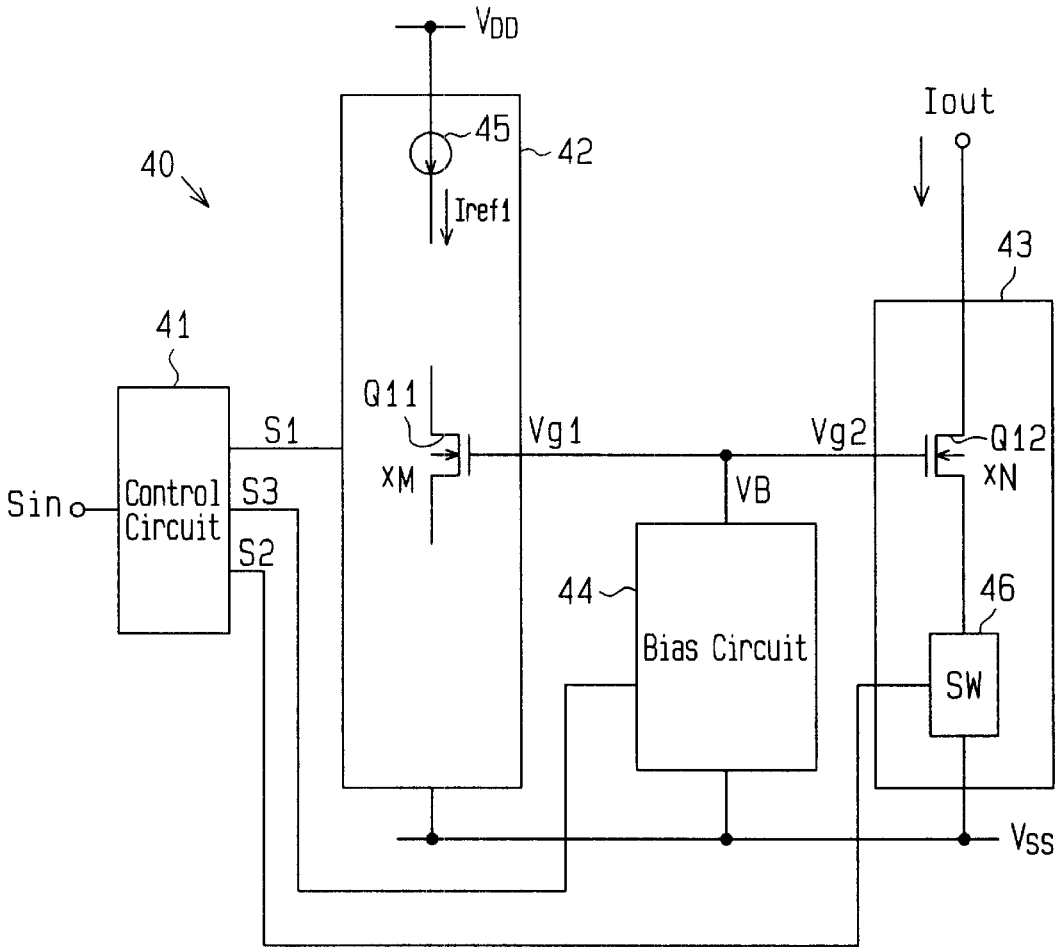
FIG. 5 is a schematic block diagram of a constant-current driver circuit of a first embodiment of the present invention.

As shown in FIG. 5, a constant-current driver circuit 40 according to a first embodiment of the present invention includes a control circuit 41, a reference current circuit 42, an output current circuit 43 and a bias circuit 44.

The control circuit 41 receives an input signal Sin and generates three control signals So to S3. The control circuit 41 provides the first control signal St. to the reference current circuit 42, the second control signal S2 to the output current circuit 43, and the third control signal S3 to the bias circuit 44.

The reference current circuit 42 includes a constant-current source 45 and an input N channel MOS transistor (a first NMOS transistor) Q11. The output current circuit 43 includes an output N channel MOS transistor (a second NMOS transistor) Q12 and an analog switch 46. The gates of the NMOS transistors Q11, Q12 are connected to each other. The NMOS transistors Q11, Q12 have sizes according to a predetermined size ratio (M:N in the present embodiment) therebetween.

The constant-current source 45 is connected to a high potential power supply VDD (a first reference potential), and provides a reference current Iref1 to the NMOS transistor Q11. The reference current circuit 42 controls the supply and the stop of the reference current Iref1 to the first NMOS transistor Q11 from the constant-current source 45 in response to the first control signal Si. The reference current circuit 42 provides a gate voltage Vg1 based on the reference current Iref1 flowing into the NMOS transistor Q11 to the gate of the NMOS transistor Q12 in synchronization with the first control signal SI.

The source of the NMOS transistor Q12 is connected to the analog switch 46, and its drain is connected to the output terminal of the constant-current driver circuit 40. The analog switch 46 is connected between the NMOS transistor Q12 and a low potential power supply VSS (a second reference potential), and is on-off controlled in response to the second signal S2. The NMOS transistor Q12 is turned on and off in accordance with the gate voltage Vg2 (Vg1) provided in synchronization with the first control signal S2.

The control circuit 41 generates the first and second signals Si, S2 such that the NMOS transistor Q12 and the analog switch 46 are turned on and off while being synchronized with each other. The output current circuit 43 generates an output current Iout in synchronization with the second control signal S2.

The bias circuit 44 generates a bias voltage VB in accordance with the third control signal S3 and provides the bias voltage VB to the gate of the transistor Q12. The control circuit 41 generates the third control signal S3 so that the bias circuit 44 operates in the opposite phase to the reference current circuit 42 and the output current circuit 43. That is, the control circuit 41 generates the third control signal S3 so that the bias voltage VB is provided to the gate of the transistor Q12 when the analog switch 46 is turned off by the second control signal S2.

For example, the control circuit 41 generates the third control signal S3 having the opposite phase to the first and second control signals S1, S2. When the reference current circuit 42 provides the gate voltage Vg1 to the transistor Q12 in accordance with the third control signal S3, the bias circuit 44 does not supply a bias voltage VB. When the reference current circuit 42 does not supply the gate voltage Vg1 to the transistor Q12, the bias circuit 44 provides the bias voltage VB. The bias voltage VB is set higher than the gate voltage, which is provided from the reference current circuit 42, substantially by a voltage ΔV. The voltage ΔV corresponds to a reduced potential of the gate voltage Vg of the output transistor Q4 of FIG. 3A.

Figure 6:
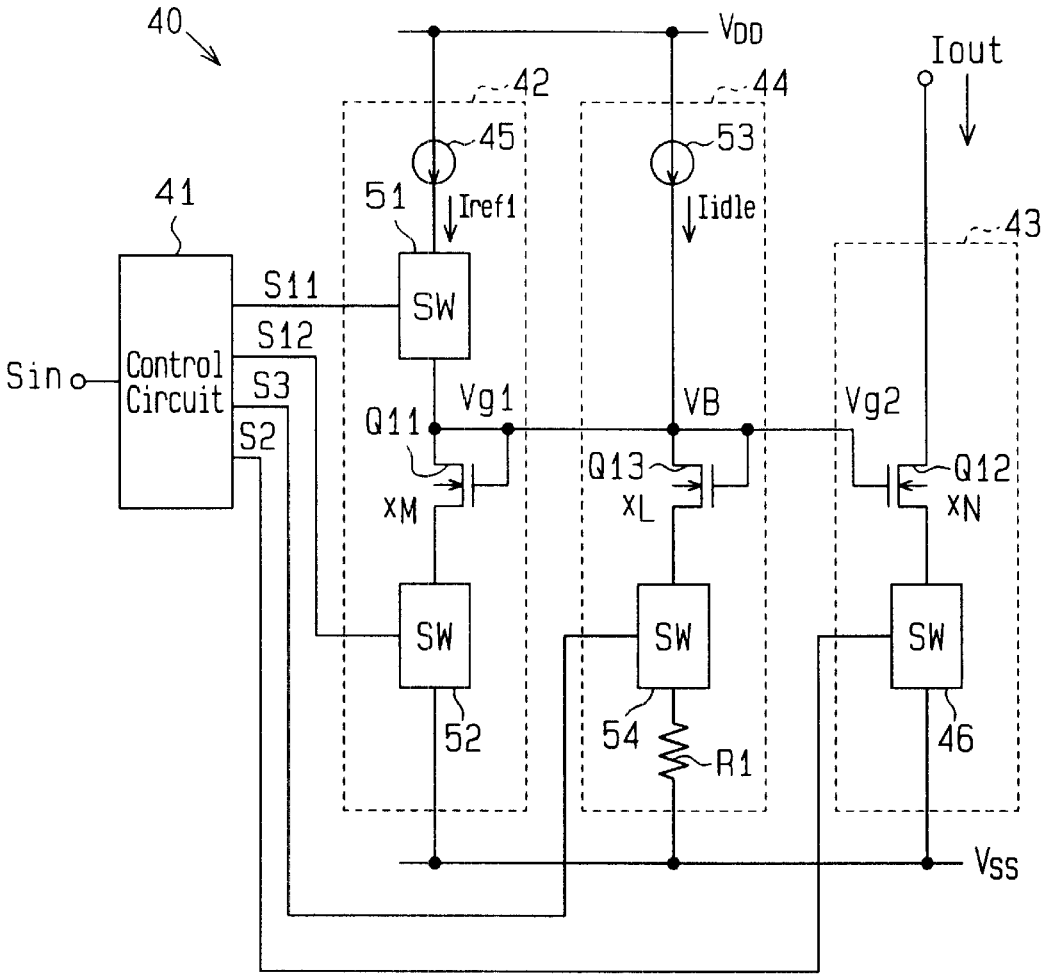
FIG. 6 is a schematic block diagram of the constant-current driver circuit of FIG. 5.

As shown in FIG. 6, the reference current circuit 42 includes first and second analog switches 51, 52. The first analog switch 51 is connected between the constant-current source 45 and the drain of the NMOS transistor Q11, and the second analog switch 52 is connected between the source of the NMOS transistor Q11 and the low potential power supply VSS. The gate of the NMOS transistor Q11 is connected to its drain as well as to the gate of the NMOS transistor Q12. The NMOS transistors Q11, Q12 form a current mirror circuit.

The control circuit 41 generates a first control signal S1 including first auxiliary control signal S11 provided to the first analog switch 51 and a second auxiliary control signal S12 provided to the second analog switch 52. The control circuit 41 generates the first and second auxiliary control signals S11, S12 so that the first and second analog switches 51, 52 are turned on and off at the same phase. Thus, the first and second analog switches 51, 52 are turned on and off in synchronization with each other, and when the first and second analog switches 51, 52 are turned on, the reference current Iref1 is provided to the NMOS transistor Q11.

The bias circuit 44 includes a constant-current source 53, an NMOS transistor Q13 (a third NMOS transistor), an analog switch 54, and a resistor R1. The constant-current source 53 is connected to a high potential power supply VDD and provides a predetermined idle current Iidle to the NMOS transistor Q13.

The gate of the NMOS transistor Q13 is connected to its drain as well as to the gate of the NMOS transistor Q12. The drain of the NMOS transistor Q13 is connected to the drain and gate of the NMOS transistor Q11.

The drain of the NMOS transistor Q13 is connected to the constant-current source 53, and the source thereof is connected to the low potential power supply VSS via the analog switch 54 and the resistor R1. The total (Iidle+Iref1) of the idle current Iidle, which is provided from the constant-current source 53, and the reference current Iref1, which is provided from the constant-current source 45, is substantially the same as the conventional reference current Iref.

The analog switch 54 is turned on or off in response to the third control signal S3. When the analog switch 54 is turned on, the analog switch 51 is turned off by the first auxiliary control signal S11. As a result, an idle current Iidle is provided to the NMOS transistor Q13 so that the bias voltage VB is provided to the gate of the NMOS transistor Q12. The bias voltage VB is a drain voltage of the NMOS transistor Q13 which is determined by the idle current Iidle, the source-gate voltage of the NMOS transistor Q13, the on resistance value of the analog switch 54 and a value of the resistor R1.

When the analog switch 54 is turned off, the first and second analog switches 51, 52 are turned on by the first and second auxiliary control signals S11, S12. As a result, the reference current Iref1 and the idle current Iidle are provided to the NMOS transistor Q11, and the drain voltage based on the currents Iref, Iidle (i.e., the gate voltage Vg1) is provided to the gate of the NMOS transistor Q12. The NMOS transistor Q12 is turned on by the gate voltage Vg2 (Vg1) to generate an output current Iout ((Iref1+Iidle)×N/M) obtained by amplification of the combined current of the reference current Iref1 and the idle current Iidle according to the transistor size ratio (N:M) between the NMOS transistors Q11, Q12.

Figures 3A, 3B:
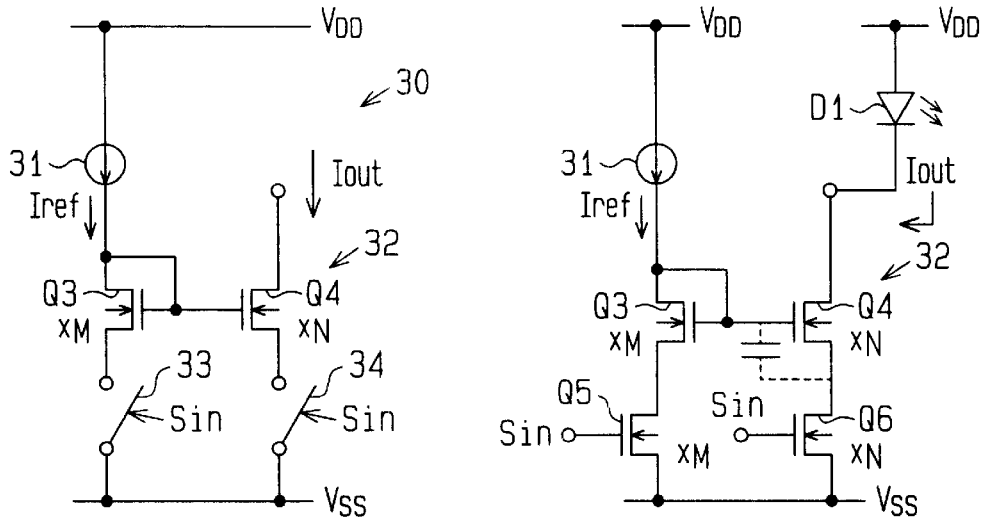
Fig.3A(Prior Art) Fig.3B(Prior Art)
FIG. 3A is a schematic circuit diagram of a third constant-current driver circuit having an analog switch.
FIG. 3B is an alternative constant-current driver circuit having a switching transistor of the prior art.
Figure 4:
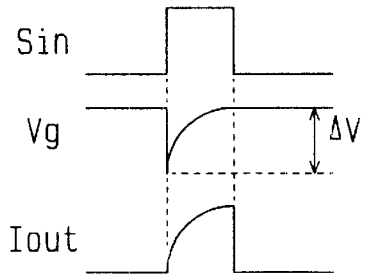
FIG. 4 is a signal waveform diagram for explaining the operation of the constant-current driver circuit of FIG. 3A.

The total of the reference and idle currents Iref1, Iidle is substantially the same as the reference current Iref of FIGS. 3A and 3B. Therefore, the current consumption in the case where the constant-current driver circuit 40 operates is not increased.

The idle current Iidle can be further significantly decreased than the reference current Iref1 in accordance with the element size of the NMOS transistor Q13 and the resistance R1. In other words, the idle current Iidle may have a value sufficient to set the bias voltage VB. Thus, current consumption generated by providing the bias voltage VB to the gate of the NMOS transistor Q12 decreases, and the increase in the current consumption of the entire constant-current driver circuit 40 is suppressed.

Figure 7:
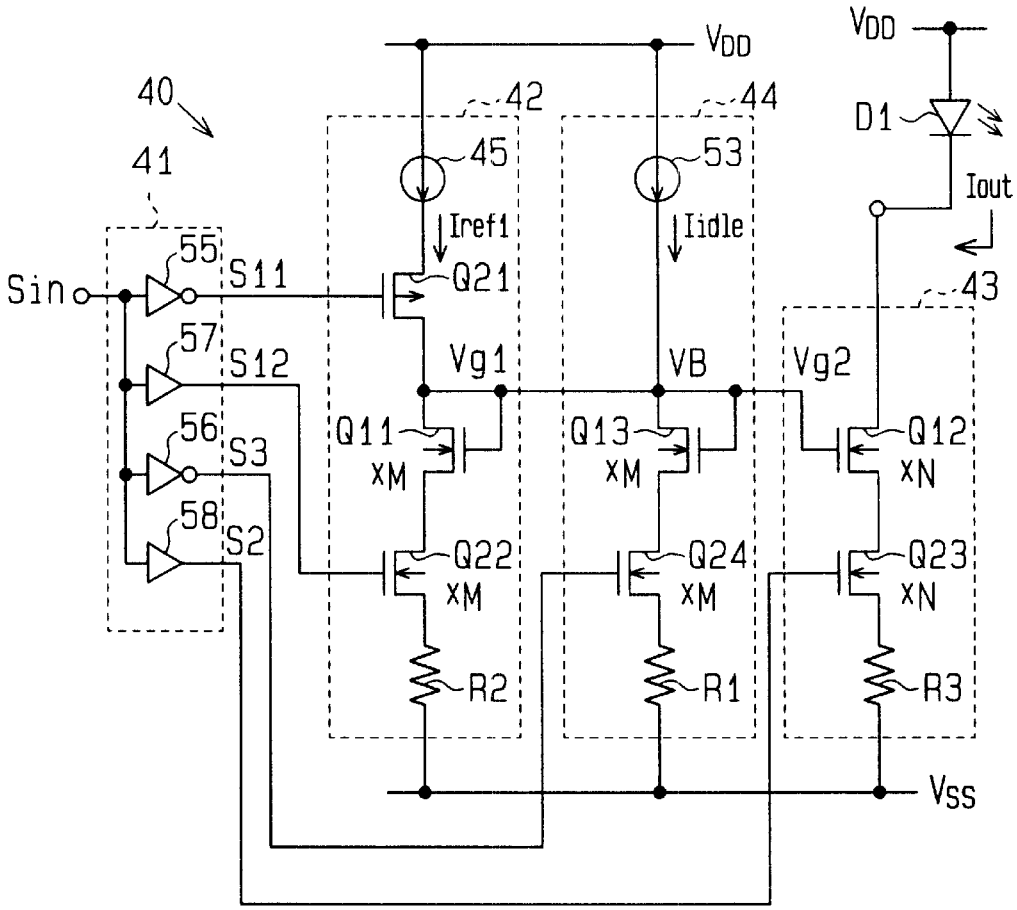
FIG. 7 is a schematic circuit diagram of the constant-current driver circuit of FIG. 5.

As shown in FIG. 7, the first analog switch 51 of FIG. 6 is preferably a P channel MOS (PMOS) transistor Q21, and the second analog switch 52 is preferably an NMOS transistor Q22. The source of the PMOS transistor Q21,is connected to the constant-current source 45, and the drain thereof is connected to the drain of the NMOS transistor Q11, and the first auxiliary control signal S11 is provided to the gate thereof. The drain of the NMOS transistor Q22 is connected to the source of the NMOS transistor Q11, and the drain of the NMOS transistor Q22 is connected to the low potential power supply VSS via the resistor R2, as well as the second auxiliary control signal S12 is provided to the gate thereof.

The analog switch 46 of FIGS. 5 and 6 is preferably an NMOS transistor Q23. The source of the NMOS transistor Q23 is connected to the low potential power supply VSS via the resistor R3, the drain thereof is connected to the source of the NMOS transistor Q12, and the second control signal S2 is provided to the gate thereof.

The resistors R2, R3 have a resistance ratio (N:M) oppositely set to the size ratio (M:N) between the NMOS transistors Q11, Q12. The NMOS transistors Q22, Q23 have an on resistance ratio (N:M) oppositely set to the size ratio (M:N) of the NMOS transistors Q11, Q12. Such setting enhances the precision of the current mirror ratio between the NMOS transistors Q11, Q12.

The analog switch 54 of FIG. 6 is preferably an NMOS transistor Q24. The source of the NMOS transistor Q24 is connected to the low potential power supply VSS via the resistor R1. The drain of the NMOS transistor Q24 is connected to the source of the third NMOS transistor Q13, and the third control signal S3 is provided to the gate thereof.

The control circuit 41 includes two inverter circuits 55, 56 and two buffer circuits 57, 58. To turn the PMOS and NMOS transistors Q21, Q22 (first and second analog switches 51, 52) on and off in the same phase, a combination of the inverter circuit 55 and the buffer circuit 57 is used. That is, the inverter circuit 55 generates the first auxiliary control signal S11 having the opposite phase to the input signal Sin, and the buffer circuit 57 generates the second auxiliary signal S12 having the same phase as the input signal Sin.

To turn the NMOS transistors Q22, Q23 on and off in the same phase, the buffer circuit 58 is used. In other words, to operate the reference current circuit 42 and the output current circuit 43 in the same phase, the buffer circuit 58 is used. The buffer circuit 58 generates the second control signal S2 having the same phase as the input signal Sin (that is, the second auxiliary control signal S12).

To turn the NMOS transistors Q23, Q24 on and off in the opposite phase to each other, the inverter circuit 57 is used. In other words, to operate the output current circuit 43 and the bias circuit 44 in the opposite phase to each other, the inverter circuit 57 is used. The inverter circuit 57 generates the third control signal S3 having the opposite phase to the input signal Sin (i.e., the second control signal S2).

Figure 8:
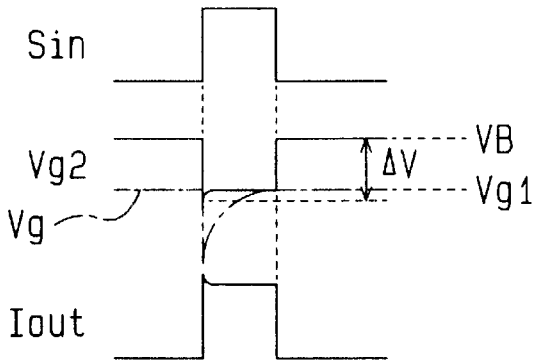
FIG. 8 is a signal waveform diagram for explaining the operation of the constant-current driver circuit of FIG. 5.

The operation of the constant-current driver circuit 40 will be explained with reference to FIG. 8.

The control circuit 41 receives the input signal Sin and generates the control signals S11, S12, S2 and S3. When the input signal Sin is at a low level, the PMOS transistor Q21 and the NMOS transistors Q22, Q23 are turned off, and the NMOS transistor Q24 is turned on. Then, the bias circuit 44 provides a bias voltage VB ($\approx$Vg1+$\Delta$V) higher than the gate voltage Vg1 by about a voltage $\Delta$V to the gate of the second NMOS transistor Q12.

Next, when a high level input signal Sin is provided, the PMOS transistor Q21 and the NMOS transistors Q22, Q23 are turned on, and the NMOS transistor Q24 is turned off. Then, the reference current circuit 42 provides the drain voltage based on the reference and idle currents Iref1, Iidle of the constant-current sources 45, 53 (i.e., the gate voltage Vg1) to the gate of the NMOS transistor Q12.

At this time, the gate voltage Vg2 of the NMOS transistor Q12 decreases by a voltage $\Delta$V from the bias voltage VB. However, since the bias voltage VB is higher than the gate voltage Vg1 by the voltage of about $\Delta$V, the reduction in the gate voltage Vg2 is suppressed to a level substantially near the gate voltage Vg1. Therefore, a gate voltage Vg2, which is provided from the reference current circuit 42 and is substantially the same as the gate voltage Vg1, is provided to the gate of the output transistor (i.e., the NMOS transistor Q12). As a result, when the NMOS transistor Q23 (analog switch 46) is turned on in response to the second control signal S2, the NMOS transistor Q12 is immediately turned on by the gate voltage Vg2 and generates the output current Iout. Thus, it takes shorter time for the rising of the output current Iout.

The constant-current driver circuit 40 of the present embodiment has the following advantages:

(1) When the output current Iout is turned on, the bias circuit 44 provides the bias voltage VB to the gate of the MOS transistor Q12. Thus, the variations in the voltage Vg2 of the MOS transistor Q12 are suppressed and the rising of the output current Iout takes a short time so that the output current Iout is on-off controlled at a high speed.

(2) The bias circuit 44 includes the resistor R1 connected between the MOS transistor Q13 and the low potential power supply VSS. The bias voltage VB can be optionally set by a resistance value of the resistor R1.

(3) When the analog switch is turned off, the idle current Iidle is provided to the MOS transistor Q11 of the reference current circuit 42, so that the gate voltage Vg1 of the MOS transistor Q11, based on the combined current of the idle current Iidle and the reference current Iref1, is set. The combined current (Iidle+Iref1) is substantially the same as the conventional reference current Iref. That is, when the bias voltage VB is not provided, the idle current Iidle is used for generating the gate voltage Vg1. Therefore, the current consumption in the case where the output current is turned on is the same as the prior art current consumption, and the increase in the current consumption is suppressed.

(4) The reference current circuit 42 includes the first analog switch 51 connected between the drain of the MOS transistor Q11 and the constant-current source 45 and the second analog switch 52 connected between the source of the MOS transistor Q11 and the low potential power supply VSS. The first and second analog switches 51, 52 are turned on and off in synchronization with each other in accordance with the first and second auxiliary control signals S11, S12. As a result, when the gate voltage Vg1 is not provided, no current flows in the reference current circuit 42. Thus, the increase in the current consumption is prevented.

(5) The reference current circuit 42 includes the second resistor R2 connected between the MOS transistor Q11 and the low potential power supply VSS, and the output current circuit 43 includes the third resistor R3 connected between the MOS transistor Q12 and the low potential power supply VSS. The resistance ratio between the resistors R2, R3 is inversely proportional to the size ratio between the MOS transistors Q11, Q12. As a result, the precision of the current mirror ratio for setting the output current Iout with respect to the reference current Iref1 is enhanced.

(6) The analog switches 52, 46 are the NMOS transistors Q22, Q23, and the on resistance ratio between the MOS transistors Q22, Q23 is inversely proportional to the size ratio between the MOS transistors Q11, Q12. As a result, the precision of the current mirror ratio setting the output current Iout with respect to the reference current Iref1 is enhanced.

Figure 9:
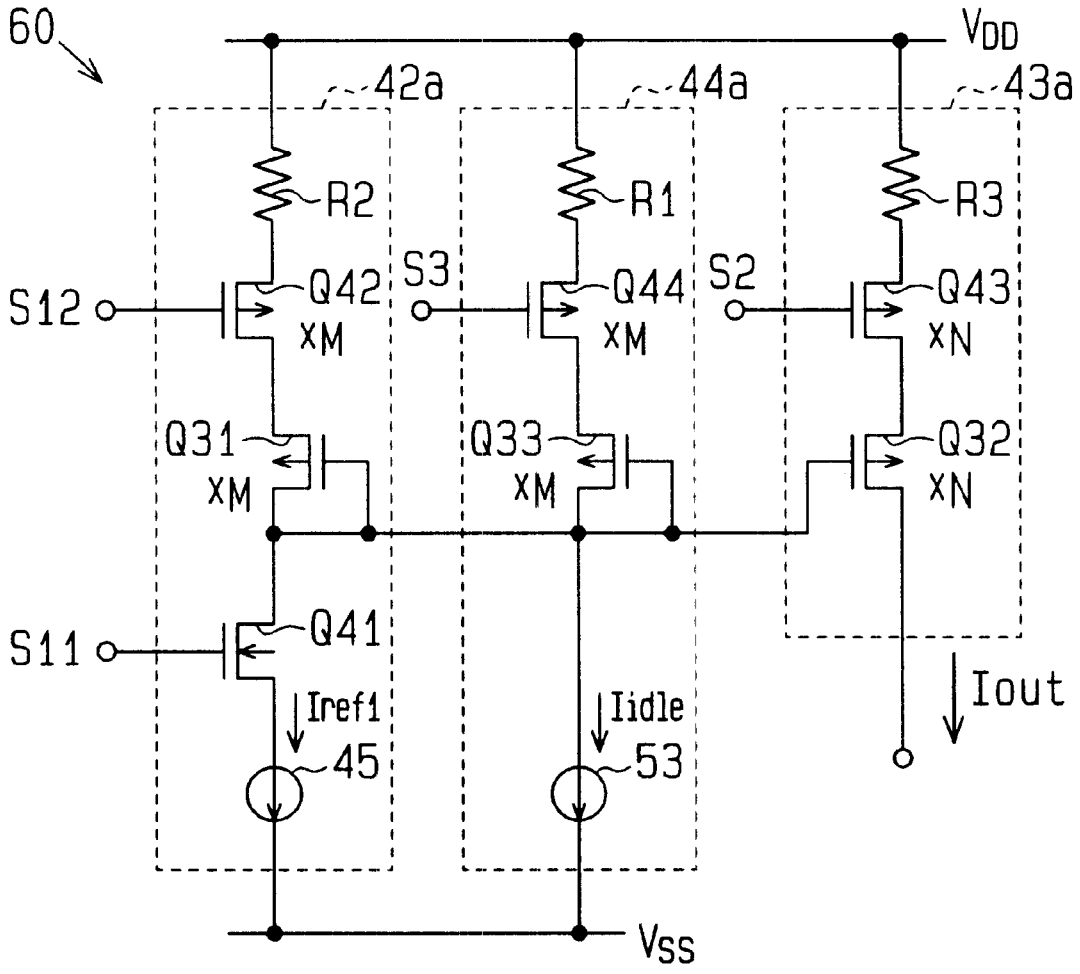
FIG. 9 is a schematic circuit diagram of a constant-current driver circuit of a first alternative example.

It should be apparent to those skilled in the art that the present invention may be embodied in many other specific forms without departing from the spirit or scope of the invention. Particularly, it should be understood that the invention may be embodied in the following forms.

a) The present invention may be embodied in a constant-current driver circuit 60 in which the PMOS transistors are exchanged to the NMOS transistors, as shown in FIG. 9. The constant-current driver circuit 60 includes a reference current circuit 42*a*, an output current circuit 43*a* and a bias circuit 44*a*. The reference current circuit 42*a* includes a constant-current source 45, an NMOS transistor Q41, a PMOS transistor Q42, a PMOS transistor (first transistor) Q31 and a resistor R2. A first auxiliary control signal S11 is provided to the gate of the NMOS transistor Q41, and a second auxiliary control signal S12 is provided to the gate of the PMOS transistor Q42. The gate of the PMOS transistor Q31 is connected to its drain and to the output current circuit 43*a*.

The output current circuit 43*a* includes a PMOS transistor (output transistor) Q32, a PMOS transistor Q43 and a resistor R3. The gate of the PMOS transistor Q32 is connected to the gate of the transistor Q31, and the second control signal S2 is provided to the gate of the PMOS transistor Q43.

The bias circuit 44*a* includes a constant-current source 53, PMOS transistors Q33, Q44, and a resistor R1. The gate of the PMOS transistors Q33 is connected to its drain and as well as to the gate of the output transistor Q32. The third control signal S3 is provided to the gate of the PMOS transistor Q44.

Figure 10:
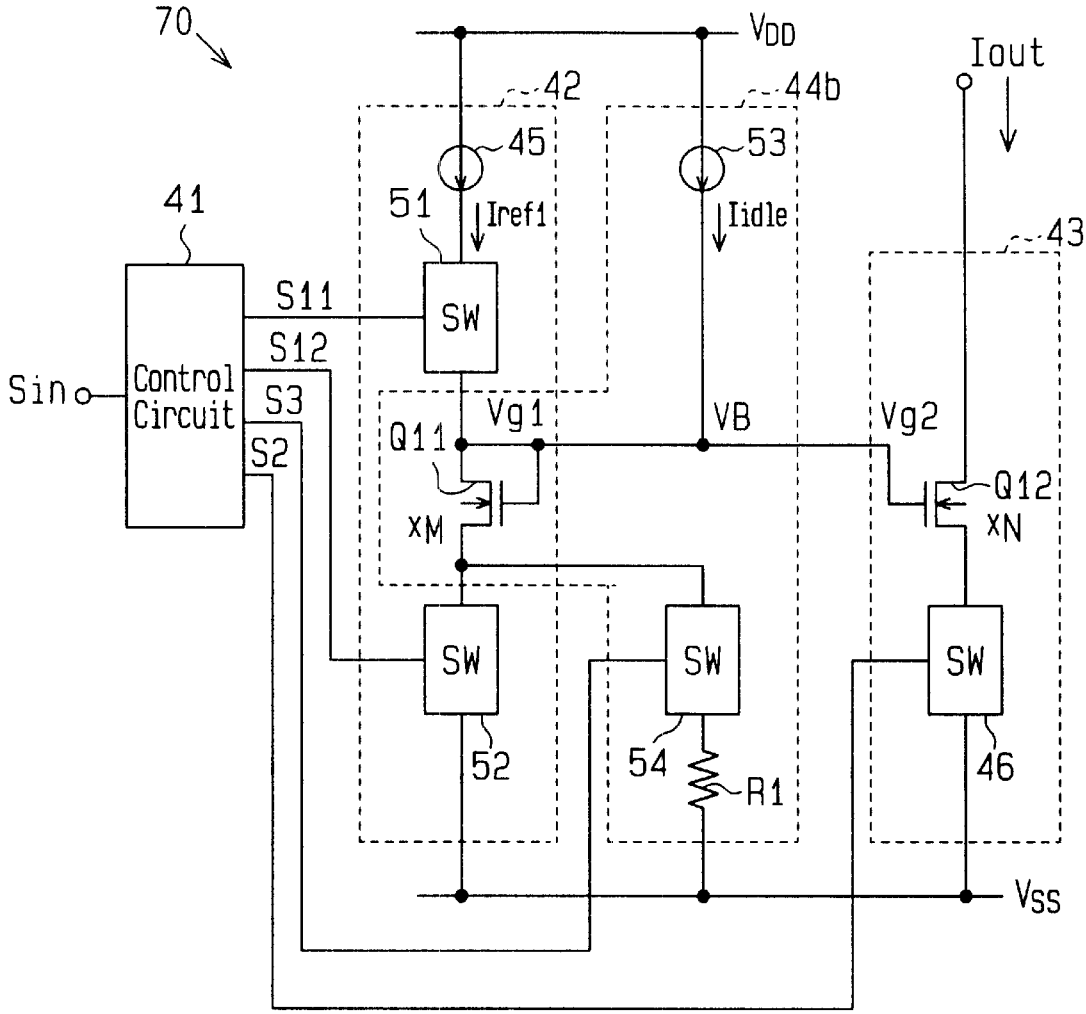
FIG. 10 is a schematic block diagram of a constant-current driver circuit of a second alternative example.
Figure 11:
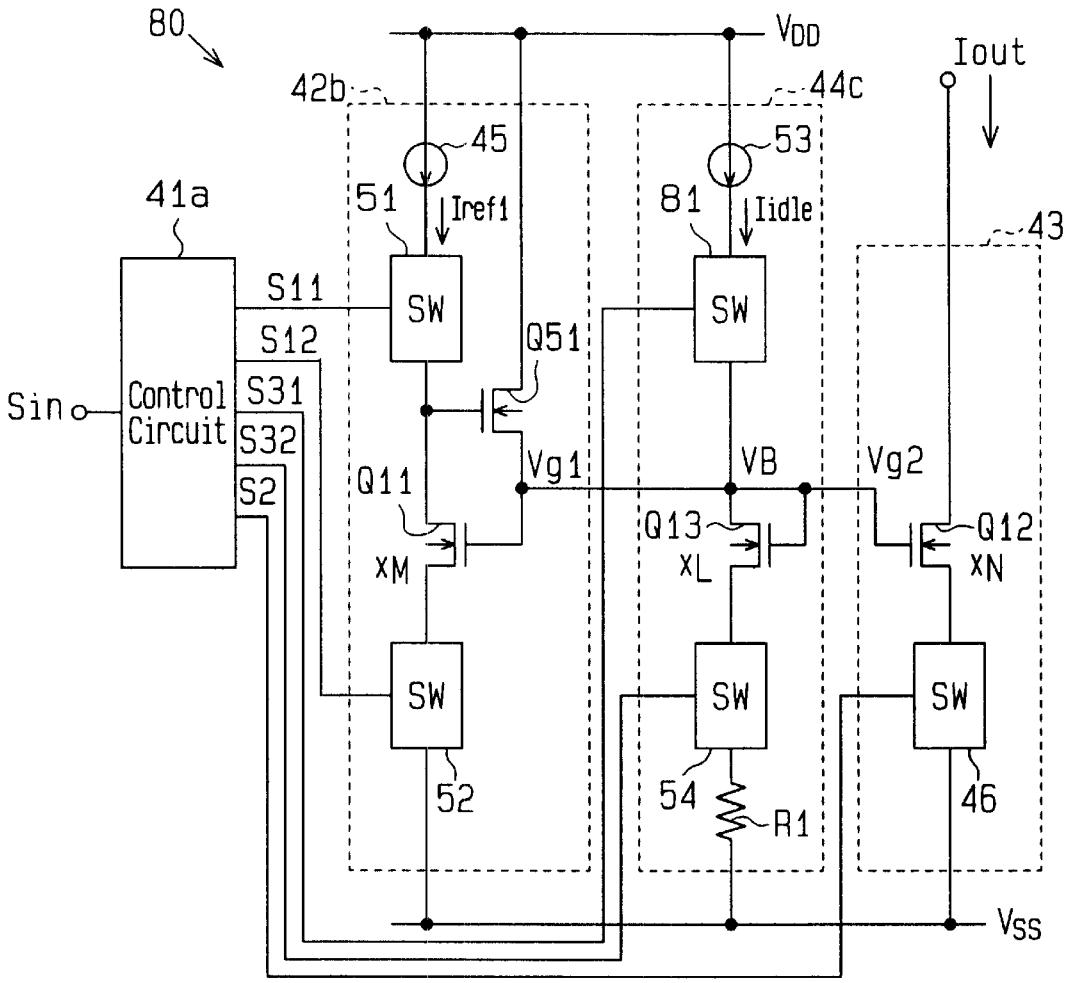
FIG. 11 is a schematic block diagram of a constant-current driver circuit of a third alternative example.

In the constant-current driver circuit 60, the output current Iout rises in a short time and is on-off controlled at a high speed.

b) The present invention may be embodied in a constant-current driver circuit 70 as shown in FIG. 10. The constant-current driver circuit 70 comprises a control circuit 41, a reference current circuit 42, an output current circuit 43 and a bias circuit 44*b*. The bias circuit 44*b* comprises a constant-current source 53, an NMOS transistor Q11, an analog switch 54 and a resistor R1. The bias circuit 44*b* generates a bias voltage VB by utilizing the NMOS transistor Q11 of the reference current circuit 42. This construction does not need the NMOS transistor Q13 and prevents the increase in the circuit area.

c) The present invention may be embodied in a constant-current driver circuit 80 as shown in FIG. 11. The constant-current driver circuit 80 includes a control circuit 41*a*, a reference current circuit 42*b*, an output current circuit 43 and a bias circuit 44*c*.

The reference current circuit 42*b* includes a constant-current source 45, an N channel MOS transistor Q11, first and second analog switches 51, 52, and an NMOS transistor Q51. The source of the NMOS transistor Q51 is connected to the gate of the NMOS transistor Q11, the gate thereof is connected to the drain of the NMOS transistor Q11, and the source thereof is connected to the high potential power supply VDD. The bias circuit 44c includes a constant-current source 53, an NMOS transistor Q13, first and second analog switches 81, 54 and a resistor R1. The first analog switch 81 is connected between the constant-current source 53 and the third NMOS transistor Q13, and is on-off controlled in response to the first auxiliary control signal S31. The second analog switch 54 is on-off controlled in response to the second auxiliary control signal S32.

The control circuit 41*a* generates auxiliary control signals S11, S12 provided to the reference current circuit 42*b*, a control signal S2 provided to the output current circuit 43, and auxiliary control signals S31, S32 provided to the bias circuit 44*c*. The control circuit 41*a* generates the auxiliary control signals S31, S32 so that the first and second analog switches 81, 54 are turned on and off in synchronization with each other.

In the constant-current driver circuit 80, an output current Iout (Iref1×N/M), which is determined by the reference current Iref1 provided from the constant-current source 45 and the size ratio between the NMOS transistors Q11, Q12, is generated.

d) The control circuit 41 may be appropriately changed. For example, the inverter circuit 55 (or 56) may generate a control signal which on-off controls the PMOS transistor Q21 (analog switch 51) of the reference current circuit 42 and the NMOS transistor Q24 (analog switch 54) of the bias circuit 44. Further, The buffer circuits 57, 58 for generating the control signals S12, S2 may be omitted.

e) The resistors R1, R2 and R3 are connected between the MOS transistors Q13, Q11, Q12 and the MOS transistors Q24, Q22, Q23, respectively.

f) The constant-current driver circuit of the present invention may be applied to driver circuits such as a constant-current driver circuit which drives a laser diode (LD), a coil driver circuit which causes current to flow to coils of various motors and the like.

Therefore, the present examples and embodiments are to be considered as illustrative and not restrictive and the invention is not to be limited to the details given herein, but may be modified within the scope and equivalence of the appended claims.

What is claimed is:

1. A constant-current driver circuit comprising:

a reference current circuit including a first MOS transistor and a first constant-current source connected to the first MOS transistor and providing a reference current to the first MOS transistor, wherein the reference current circuit generates a gate voltage of the first MOS transistor in accordance with a first control signal;

an output current circuit including a second MOS transistor generating an output current having a predetermined ratio to the reference current, a gate of the second MOS transistor being connected to a gate of the first MOS transistor, and a first switch circuit connected to the second MOS transistor in series to on-off control the output current in accordance with a second control signal;

a bias circuit connected to a gate of the second MOS transistor to provide a bias voltage to the gate of the second MOS transistor in accordance with a third control signal, wherein variation in the gate voltage of the second MOS transistor in the on control of the output current is suppressed; and a control circuit connected to the reference current circuit, the output current circuit and the bias circuit, receiving an input signal and generating the first to third control signals, wherein the reference current circuit and the output current circuit are operated in the same phase, and the bias circuit is operated in the opposite phase to the reference current circuit and the output current circuit.

2. A constant-current driver circuit comprising:

a reference current circuit including a first MOS transistor and a first constant-current source connected to the first MOS transistor and providing a reference current to the first MOS transistor, wherein the reference current circuit generates a gate voltage of the first MOS transistor in accordance with a first control signal;

an output current circuit including a second MOS transistor generating an output current having a predetermined ratio to the reference current, a gate of the second MOS transistor being connected to a gate of the first MOS transistor, and a first switch circuit connected to the second MOS transistor in series to on-off control the output current in accordance with a second control signal; and a bias circuit connected to a gate of the second MOS transistor to provide a bias voltage to the gate of the second MOS transistor in accordance with a third control signal, wherein variation in the gate voltage of the second MOS transistor in the on control of the output current is suppressed, wherein the bias current circuit includes:

a third MOS transistor, a gate and a drain of the third MOS transistor being connected to the gate of the second MOS transistor;

a second constant-current source connected to the third MOS transistor, providing an idle current to the third MOS transistor; and a second switch circuit connected between the third MOS transistor and a predetermined power supply and being on-off controlled in response to the third control signal.

3. The constant-current driver circuit according to claim 2, wherein the bias circuit includes a resistor connected between the second switch circuit and the predetermined power supply, the bias voltage being set by a resistance value of the resistor.

4. The constant-current driver circuit according to claim 2, wherein the second constant-current source is also connected to the first MOS transistor, and when the second switch circuit is turned off, the idle current is provided to the first MOS transistor, and the gate voltage of the first MOS transistor is set based on a combined current of the idle current and the reference current.

5. A constant-current driver circuit comprising:

a reference current circuit including a first MOS transistor and a first constant-current source connected to the first MOS transistor and providing a reference current to the first MOS transistor, wherein the reference current circuit generates a gate voltage of the first MOS transistor in accordance with a first control signal;

an output current circuit including a second MOS transistor generating an output current having a predetermined ratio to the reference current, a gate of the second MOS transistor being connected to a gate of the first MOS transistor, and a first switch circuit connected to the second MOS transistor in series to on-off control the output current in accordance with a second control signal; and a bias circuit connected to a gate of the second MOS transistor to provide a bias voltage to the gate of the second MOS transistor in accordance with a third control signal, wherein variation in the gate voltage of the second MOS transistor in the on control of the output current is suppressed, wherein the reference current circuit includes a second switch circuit connected between the source of the first MOS transistor and a predetermined power supply and being on-off controlled in response to the first control signal.

6. The constant-current driver circuit according to claim 5, wherein the first switch circuit is a third MOS transistor, the second switch circuit is a fourth MOS transistor, and an on resistance ratio between the third and fourth MOS transistors is inversely proportional to a size ratio between the first and second MOS transistors.

7. A constant-current driver circuit comprising:

a reference current circuit including a first MOS transistor and a first constant-current source connected to the first MOS transistor and providing a reference current to the first MOS transistor, wherein the reference current circuit generates a gate voltage of the first MOS transistor in accordance with a first control signal;

an output current circuit including a second MOS transistor generating an output current having a predetermined ratio to the reference current, a gate of the second MOS transistor being connected to a gate of the first MOS transistor, and a first switch circuit connected to the second MOS transistor in series to on-off control the output current in accordance with a second control signal; and a bias circuit connected to a gate of the second MOS transistor to provide a bias voltage to the gate of the second MOS transistor in accordance with a third control signal, wherein variation in the gate voltage of the second MOS transistor in the on control of the output current is suppressed, wherein the reference current circuit includes:

a second switch circuit connected between a drain of the first MOS transistor and the first constant-current source; and a third switch circuit connected between a source of the first MOS transistor and a predetermined power supply, wherein the first and second switch circuits are on-off controlled in response to the first control signal.

8. A constant-current driver circuit comprising:

a reference current circuit including a first MOS transistor and a first constant-current source connected to the first MOS transistor and providing a reference current to the first MOS transistor, wherein the reference current circuit generates a gate voltage of the first MOS transistor in accordance with a first control signal;

an output current circuit including a second MOS transistor generating an output current having a predetermined ratio to the reference current, a gate of the second MOS transistor being connected to a gate of the first MOS transistor, and a first switch circuit connected to the second MOS transistor in series to on-off control the output current in accordance with a second control signal; and a bias circuit connected to a gate of the second MOS transistor to provide a bias voltage to the gate of the second MOS transistor in accordance with a third control signal, wherein variation in the gate voltage of the second MOS transistor in the on control of the output current is suppressed, wherein the reference current circuit includes a first resistor connected between the first MOS transistor and a predetermined power supply, and the output current circuit includes a second resistor connected between the second MOS transistor and the predetermined power supply, and wherein a resistance ratio between the first and second resistors is inversely proportional to a size ratio between the first and second MOS transistors.

* * * * *